US007387280B2

(12) United States Patent
Fritz et al.

(10) Patent No.: US 7,387,280 B2
(45) Date of Patent: Jun. 17, 2008

(54) POINTS COMPRISING A REINFORCED SWITCH TONGUE BLADE

(75) Inventors: Dieter Fritz, Fohnsdorf (AT); Hermann Orasche, Zeltweg (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 332 days.

(21) Appl. No.: 10/518,936

(22) PCT Filed: Jun. 16, 2003

(86) PCT No.: PCT/AT03/00170

§ 371 (c)(1),
(2), (4) Date: Sep. 21, 2005

(87) PCT Pub. No.: WO2004/003295

PCT Pub. Date: Jan. 8, 2004

(65) Prior Publication Data

US 2006/0097115 A1 May 11, 2006

(30) Foreign Application Priority Data

Jun. 27, 2002 (AT) ..... A 967/2002

(51) Int. Cl.
*E01B 7/00* (2006.01)

(52) U.S. Cl. ..... 246/435 R; 246/436; 246/438; 246/442

(58) Field of Classification Search ..... 246/436, 246/435 R, 437, 438, 442, 229, 415 R
See application file for complete search history.

(56) References Cited

U.S. PATENT DOCUMENTS

| | | | | |
|---|---|---|---|---|
| 175,699 A | | 4/1876 | Harreff | |
| 652,033 A | | 6/1900 | MacPherson | |
| 1,103,720 A | | 7/1914 | Whiteman | |
| 1,177,670 A | | 4/1916 | Woods et al. | |
| 1,459,022 A | * | 6/1923 | Fernekes | 246/435 R |
| RE18,216 E | * | 9/1931 | Strong | 246/437 |
| 3,403,251 A | * | 9/1968 | Sosa et al. | 246/415 R |
| 3,488,490 A | * | 1/1970 | Thornton | 246/415 R |
| 4,925,135 A | * | 5/1990 | Ziethen et al. | 246/436 |
| 5,590,833 A | * | 1/1997 | Benenowski et al. | 238/171 |
| 6,068,196 A | * | 5/2000 | Benenowski et al. | 238/171 |
| 6,588,710 B1 | * | 7/2003 | Taylor | 246/220 |
| 2002/0079634 A1 | * | 6/2002 | Lesemann | 269/309 |

FOREIGN PATENT DOCUMENTS

| | | |
|---|---|---|
| DE | 487877 | 12/1929 |
| DE | 498902 | 6/1930 |

* cited by examiner

*Primary Examiner*—Mark T Le
(74) *Attorney, Agent, or Firm*—Chapman and Cutler LLP

(57) ABSTRACT

In a switch including a main track and a branch track, wherein one rail of each track is each configured as a tongue rail and movable into abutment on the respective stock rail, at least one stock rail (1), in its region of abutment on the tongue rail (2), is designed to have a reduced rail head width as compared to the region located outside said region of abutment, wherein the rail head width, starting from the tip (3) of the tongue, decreases as far as to a point (4) at which the carrying wheel comes into lateral contact with the tongue rail (2) and increases in the region following thereupon, and that the tongue rail (2) is designed to be reinforced in cross section towards the stock rail (1) according to the reduction in the width of the stock rail head.

20 Claims, 2 Drawing Sheets

POINTS COMPRISING A REINFORCED SWITCH TONGUE BLADE

The invention relates to a switch including a main track and a branch track, wherein one rail of each track is each configured as a tongue rail and movable into abutment on the respective stock rail.

When passing a switch, high forces and, in particular, high transverse forces depending, in particular, on the radius of curvature and the deviation angle of the switch, on the speed at which the switch is passed, and on the axle load, are exerted on the rails. The major portion of these transverse forces must be taken up by the tongue rail, wherein especially high loads caused by the high inertial and centrifugal forces are to be observed, in particular, with inside curve switches, in which the branch track branches off a curved main track towards the inner side of the curve. This entails increased wear and a considerably reduced life time. Moreover, modern switches have to be passable at very high speeds, which will inevitably lead to tongue rails having long, thin tips and hence elevated susceptibility to wear. Consequently, it has already been proposed several times to produce tongue rails of special, wear-resistant materials or harden them by subsequent treatment. This involves, however, a number of disadvantages, wherein, for instance, head-hardened tongue rails will generally not be employed for safety reasons, because possible wear phenomena on the tongue rail should be visible so as to enable the premature recognition of possible risks of fracture. Yet, fractures with head-hardened tongue rails are mostly brittle fractures, which make early detection impossible.

In the past, thickness-reinforced tongue rails have, therefore, been frequently proposed to enable the safe absorption of transverse forces. Thus, tongue rails have become known from German Offenlegungsschrift No. 2,046,391, whose tongue ends comprise reinforcements in the direction towards the stock rails, to which recesses provided on the inside edges of the stock rails correspond. The tongue rail, in its position adjacent the stock rail, engages in the recesses of the stock rail so as to provide a continuous running edge in the region of transition from the stock rail to the tongue. However, in the configuration according to German Offenlegungsschrift No. 2,046,391, the recesses provided in the stock rail cause substantial weakening of the stock rail, and it is, therefore, necessary to fill the recesses of the stock rail with tightening keys in the open position of the tongue. From EP 040 533 A2 it is, furthermore, known to reduce the width of a stock rail in its head and foot regions in a zone in which the tongue rail abuts on the stock rail, so as to enable the tongue to be designed in correspondence with the profile of the rail head in this transition region. Yet, with that solution too, the profile of the stock rail is strongly weakened, thus causing an elevated risk of fracture. In order not to have to extensively reduce the cross section of the stock rail while, nevertheless, obtaining an adequate reinforcement of the tongue rail, the rail head profile of the stock rail is frequently milled off obliquely downwards in the region of contact of the tongue, as is, for instance, disclosed in German Patent No. 487 877.

In the main, the proposals that have become known for reinforcing the cross section of a tongue rail in the region of abutment are not to be regarded as fully satisfactory, since no substantial improvement of the wear resistance of tongue rails has been observed and, in addition, undesired changes in the course of the inside edge are brought about by the material reduction on the inside edge of the stock rail. Deviations from the straight-line course of the inside edge produce harsh shocks on the vehicle at high speeds and will, therefore, have to be avoided in any event. The object of the present invention is consequently to provide a tongue rail that offers an enhanced wear resistance and extended working life by a reinforcement of the tongue in its front region so as to increase safety by avoiding any risk of fracture, while the original course of the inside edge, at the same time, is to be affected as little as possible in order to increase comfort when passing the switch.

To solve this object, the invention essentially consists in that at least one stock rail, in its region of abutment on the tongue rail, is designed to have a reduced rail head width as compared to the region located outside said region of abutment, wherein the rail head width, starting from the tip of the tongue, decreases as far as to a point at which the carrying wheel comes into lateral contact with the tongue rail and increases in the region following thereupon, and that the tongue rail is designed to be reinforced in cross section towards the stock rail according to the reduction in the width of the stock rail head. By making the reduction in the width of the stock rail cross section, or reinforcement of the tongue rail, not uniformly strong in the region of abutment of the tongue rail on the stock rail, but allow it to increase in a first region and decrease in a second region following thereupon, it has become feasible to adapt the degree of reinforcement of the tongue rail to the course of the transverse forces.

When passing a switch, particularly high forces will act on the tongue rail in the region in which the carrying wheel comes into lateral contact with the tongue rail, and that is why according to the invention the width of the rail head is designed to decrease from the tip of the tongue as far as to a point at which the carrying wheel comes into lateral contact with the tongue rail, and to increase in the region following thereupon until the end of abutment of the tongue rail on the stock rail, whereby the tongue rail is naturally designed to be reinforced according to this course. The largest reinforcement of the tongue rail is, thus, provided in the sensitive transition region of the load from the stock rail to the tongue rail, and, as a result, an increase in the cross section and hence an increase in the moment of inertia of the tongue rail are obtained, which enable the tongue rail to better withstand the elevated transverse forces. At the same time, the course of the inside edge of the stock rail changes only negligibly such that no adverse effects in the running behaviour are to be observed with the open tongue. Due to the preferably constant cross-sectional change, jerky track changes will be avoided such that the ride comfort will not be negatively influenced and shock loads on the rails will be inhibited.

The inside or running edge of a rail on the rail head is present on the widest site as measured at a predefined or standardized vertical distance from the top edge. In this case, the width of the stock rail head, which according to the invention is preferably designed to initially decrease in the region of abutment of the tongue rail and subsequently increase, is measured at a vertical distance of 10 to 20 mm, particularly 14 mm, from the top edge. In order to weaken as little as possible the cross section of the stock rail while, nevertheless, reaching sufficient reinforcement of the tongue rail, the configuration advantageously is further developed such that the stock rail is designed to be chamfered in the region of abutment of the tongue rail with the chamfer extending in an inclined manner from the inside edge towards the rail web. Such a chamfer departing from the inside edge of the stock rail, in addition, renders feasible to design the tongue in a reinforced manner without excessively affecting the course of the inside edge.

In the rounded region on the transition between the top edge and the inside edge, the intersection of the chamfer with the profile of the stock rail head naturally results in an edge that is contacted by the wheel flange of the carrying wheel. According to a preferred embodiment of the switch according to the invention, said edge resulting from the intersection of the chamfer with the profile of the stock rail head is designed to be rounded, said rounded design being, moreover, advantageously devised in a manner that the profile of the stock rail head is designed with a curvature on the transition from the top edge to the chamfer, the radius of which curvature is smaller than that of the corresponding curved region of the profile of a standard rail. An overhang is, thus, formed in this region such that only a very slight track change will occur despite the reduction in the width of the stock rail head. In addition, such a configuration helps optimize the contact geometry between the flange of the carrying wheel in the transition region of the carrying wheel from the stock rail to the tongue rail such that a particularly jerk-free transition will be ensured in this region.

A particularly stressable and wearable switch will result, if the largest reinforcement of the tongue rail is provided in that region in which the carrying wheel comes laterally into contact with the tongue rail as already mentioned, and, according to a preferred configuration, the switch according to the invention is, therefore, further developed in a manner that the point with the largest reinforcement of the tongue rail, or smallest width of the stock rail head, is located at a distance from the tip of the tongue, which amounts to ⅕ to ⅓, preferably ¼, of the length of the region of abutment of the tongue rail on the stock rail. The largest deviation of the course of the inside edge from the standard course naturally is to be observed on that point, and the extent of reinforcement of the tongue rail, or reduction in the width of the stock rail, therefore is to be chosen such that an enhanced wear resistance at a simultaneous change in the inside edge as small as possible will be ensured. In this context, a particularly advantageous configuration will be achieved if the maximum width reduction of the stock rail, or maximum reinforcement of the tongue rail, is 2 to 5 mm and, preferably, 3 mm.

As already mentioned, a particularly jerk-free transition of the carrying wheel from the stock rail to the tongue rail is sought, and in this context the switch according to the invention in an advantageous manner is further developed such that the vertical height of the tongue rail increases in the region of abutment on the stock rail in the direction towards the end of abutment, departing from the tip of the tongue. This ensures a continuous transition of the rolling load from the stock rail onto the tongue rail, whereby the contact geometry will be further improved in this region, if, as in accordance with a preferred configuration, the inner flank of the flange of the carrying wheel, which preferably encloses an angle of 50° to 70° and, in particular, 60° with the axle of the carrying wheel, extends parallel with a tangent drawn at the tongue rail and the stock rail, or contacts the rails along that tangent, at least in the region of the largest reinforcement of the tongue rail. This ensures the contact of the carrying wheel with both the tongue rail and the stock rail, particularly in the region of overriding of the tongue rail by the carrying wheel, despite the reinforcement of the tongue cross section, whereby the carrying wheel is prevented from ascending.

As already mentioned, the reinforcement according to the invention of the cross section of the tongue rail, and the enhanced wear resistance resulting therefrom, are of particular advantage in switch geometries in which high transverse forces occur. The switch according to the invention is, therefore, advantageously comprised of an inside curve switch, wherein the curve outer tongue rail is designed to be reinforced in cross section. The fact that, in the event of inside curve switches, particularly high transverse forces act on the curve outer tongue rail because of the smaller radius of curvature and the enlarged deviation angle is thereby taken into account.

In the following, the invention will be explained in more detail by way of an exemplary embodiment schematically illustrated in the drawing. Therein:

Figure 1:
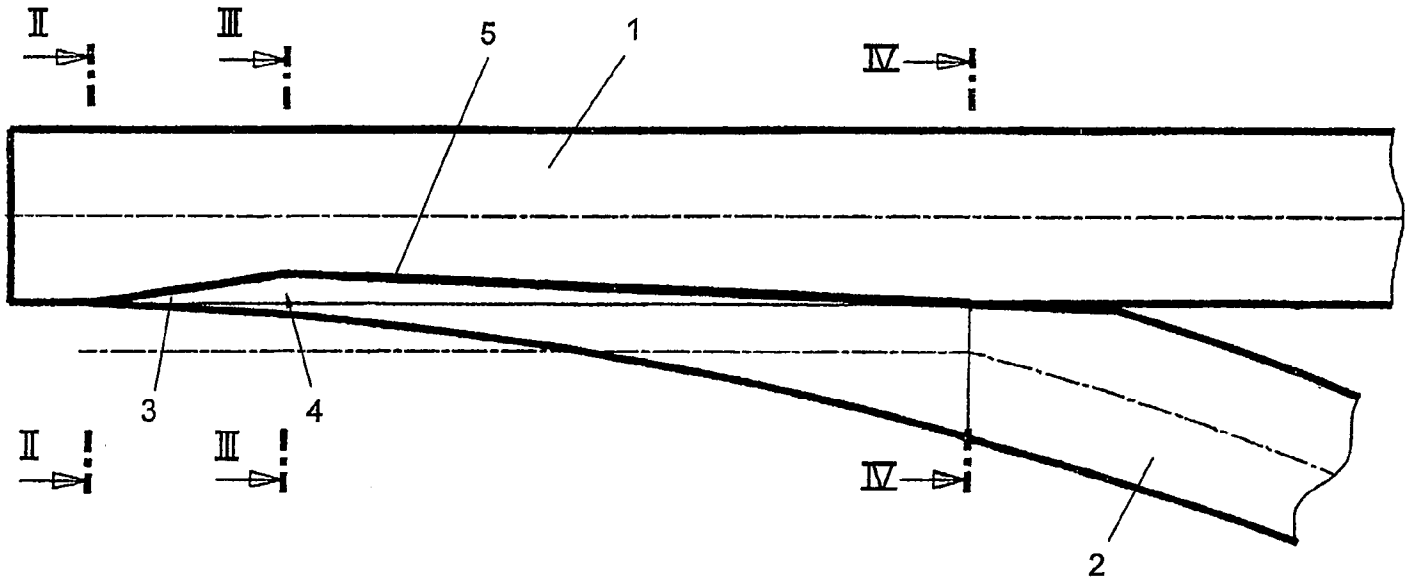
FIG. 1 is a top view on the switch region in which the tongue rail comes into abutment on the stock rail.
Figure 3:
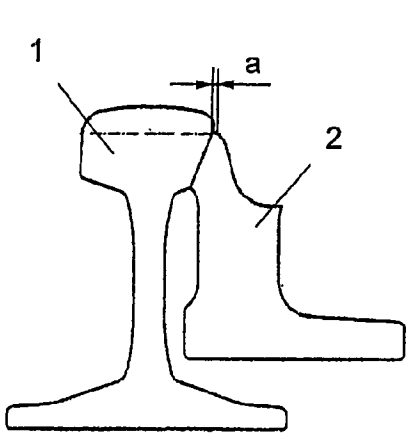
FIG. 3 is a section along line 3-3 of FIG. 1.
Figure 4:
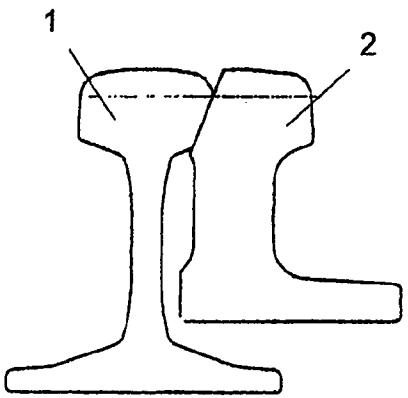
FIG. 4 is a section along line 4-4 of FIG. 1.
Figure 2:
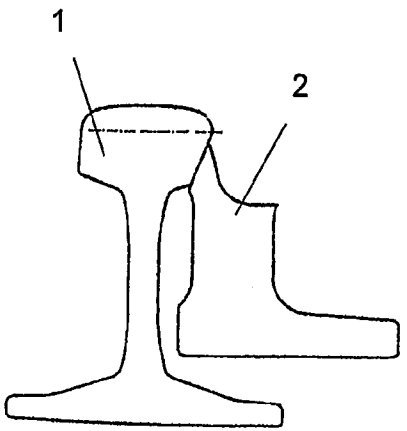
FIG. 2 is a section along line 2-2 of FIG. 1.

In FIG. 1, the stock rail of the main track is denoted by 1 and the tongue rail of the branch track is denoted by 2, only that region in which the tongue rail 2 contacts the stock rail 1 being illustrated. The running or inside edge is formed on the respectively widest site of the stock rail 1, wherein it is apparent from FIG. 1 that the inside edge does not extend linearly, but that the width of the stock rail 1 is designed to decrease from the region of the tip 3 of the tongue of the tongue rail 2 as far as to region 4 and increase again in the region following thereupon, from which results a buckled course of the inside edge 5. The tongue rail 2 is reinforced in the direction towards the stock rail 1 according to the reduction in width of the stock rail 1, the largest reinforcement being provided in the region 4 in which the carrying wheel comes into lateral contact with the tongue rail. From the sectional views according to FIGS. 2, 3 and 4, it is only apparent that the reduction in width of the stock rail head is obtained by a chamfer or undercut on the rail head. The extent of the undercut is the largest in the region 4 to which the sectional view according to FIG. 3 corresponds and in which the tongue rail 2 is, thus, most strongly widened, since the wear due to jerkily introduced transverse forces is the largest in this region. From the sectional views according to FIGS. 2, 3 and 4, it is further apparent that the vertical height of the tongue rail 2 is designed to increase from the tip 3 of the tongue as far as to a region near the end of the abutment of the tongue rail 2 on the stock rail 1. Thus, a jerk-free and continuous takeover of the rolling stock by the tongue rail 2 will be ensured.

Figure 5:
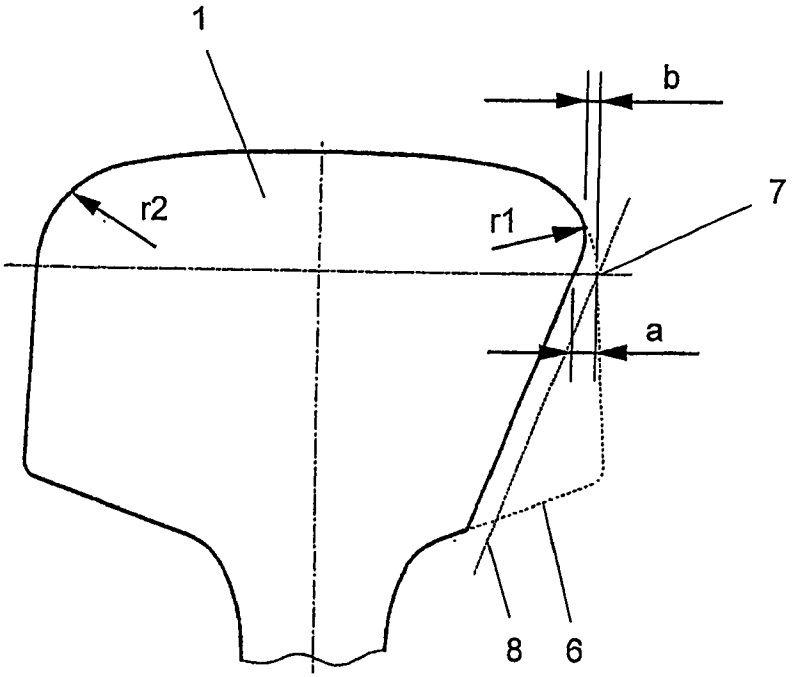
FIG. 5 is an enlarged illustration of the stock rail head according to FIG. 3.

FIG. 5 is a cross sectional view through the stock rail head at point 4, at which the width of the stock rail 1 is most strongly reduced. Broken line 6 indicates the standard profile of the stock rail 1, as it is formed beyond the region of abutment of the tongue rail 2. The inside edge of the standard profile indicated by broken line 6 in this case extends at the point referenced by 7, a chamfer or undercut as formed according to known or prior art configurations and extending from the inside edge 7 obliquely downwards to facilitate the abutment of the tongue rail 2 being indicated by 8. By contrast, the undercut according to the invention is designed to increase from the region of the tip 3 of the tongue as far as to point 4 such that point 4 will have the stock rail head profile illustrated in FIG. 5 in full lines. The width of the stock rail 1 is, thus, reduced by the distance a with the tongue rail 2 naturally being reinforced by the same extent. The curved region located in the transition region from the chamfer to the standard profile in this case may be designed with a radius r1 which is smaller than the radius r2 corresponding to the curvature of the standard profile. Hence results a displacement of the inside edge by a distance of merely b, which distance is smaller than the distance a by which the width of the stock rail is reduced.

Figure 6:
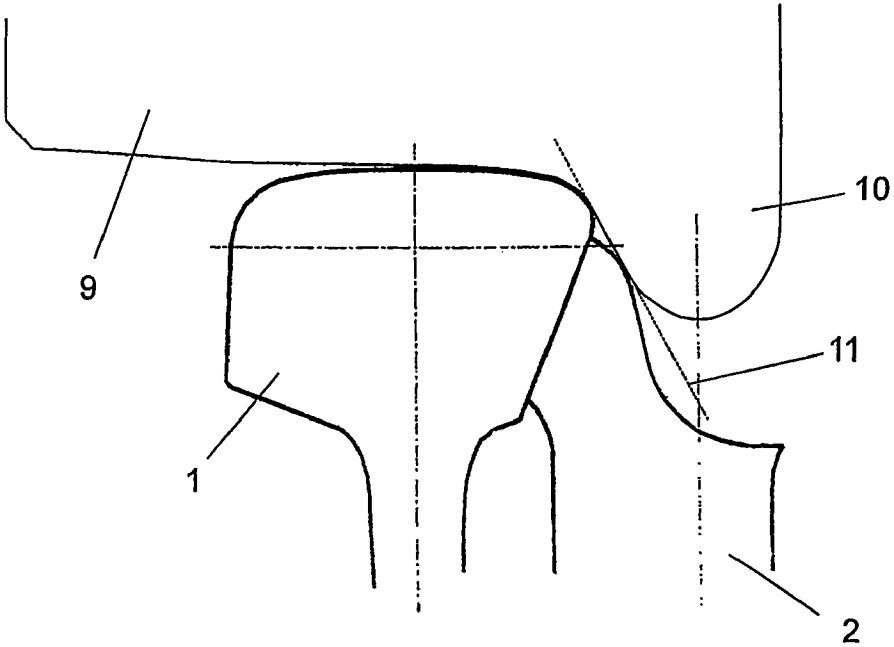
FIG. 6 is an enlarged sectional illustration of the stock rail head with the abutting tongue rail according to FIG. 3.

FIG. 6, in addition to the stock rail 1, depicts the adjacent tongue 2, the carrying wheel 9 with its flange 10 being indicated by broken lines. The geometry in this case has been optimized in a manner that the inner flank 11 of the wheel flange 10 forms a tangent common to the stock rail 1 and the tongue rail 2.

Overall, the invention provides a switch that offers an enhanced wear resistance and extended lay-days and, thus, provides an increased safety by a reduced risk of fracture. The contact geometry has been optimized so as to ensure as little influence as possible on the inside edge.

The invention claimed is:

1. A switch comprising a maintrack and a branch track, each one of said tracks comprising a tongue rail and a respective stock rail, said tongue rail being movable into abutment on said respective stock rail, wherein at least one of said stock rails (1), in its region of abutment on the tongue rail (2), is formed to have a reduced rail head width as compared to a region located outside said region of abutment, wherein the rail head width, starting from a tip (3) of a tongue of said tongue rail (2), decreases as far as to a point (4) at which a carrying wheel comes into lateral contact with the tongue rail (2) and increases in a region following said point (4), and the tongue rail (2) is reinforced in cross section towards the stock rail (1) in correlation with the reduction in the width of the stock rail head.

2. A switch according to claim 1, wherein the width of the stock rail head is measured at a vertical distance of 10 to 20 mm from a top edge of the stock rail head.

3. A switch according to claim 1, wherein the stock rail (1) is chamfered in the region of abutment on the tongue rail (2) with the chamfer extending in an inclined manner from an inside edge towards a rail web.

4. A switch according to claim 3, wherein an edge resulting from intersection of the chamfer with a profile of the stock rail head is rounded.

5. A switch according to claim 3, wherein a profile of the stock rail head is formed to have a curved region on a transition from a top edge of the stock rail head to the chamfer, the radius of which curved region is smaller than that of a corresponding curved region of a standard rail profile.

6. A switch according to claim 1, wherein a point with largest reinforcement of the tongue rail (2), or smallest width of the stock rail head, is located at a distance from the tip (3) of the tongue, which amounts to ⅕ to ⅓ of the length of said region of abutment of the tongue rail (2) on the stock rail (1).

7. A switch according to claim 1, wherein maximum head width reduction of the stock rail (1), or maximum reinforcement of the tongue rail (2), is 2 to 5 mm.

8. A switch according to claim 1, wherein vertical height of the tongue rail (2) increases in the region of abutment on the stock rail (1) in the direction towards the end of abutment, departing from the tip (3) of the tongue.

9. A switch according to claim 1, wherein an inner flank of a flange of the carrying wheel, which encloses an angle of 50° to 70° with an axle of the carrying wheel, extends parallel with a tangent drawn at the tongue rail (2) and the stock rail (1), or contacts the rails along that tangent, at least in a region of largest reinforcement of the tongue rail (2).

10. A switch according to claim 1, wherein the switch is comprised of an inside curve switch, and a curve outer tongue rail is reinforced in cross section.

11. A switch according to claim 2, wherein the stock rail (1) is chamfered in the region of abutment on the tongue rail (2) with the chamfer extending in an inclined manner from an inside edge towards a rail web.

12. A switch according to claim 4, wherein a profile of the stock rail head is formed to have a curved region on a transition from a top edge of the stock rail head to the chamfer, the radius of which curved region is smaller than that of a corresponding curved region of a standard rail profile.

13. A switch according to claim 2, wherein a point with largest reinforcement of the tongue rail (2), or smallest width of the stock rail head, is located at a distance from the tip (3) of the tongue, which amounts to ⅕ to ⅓ of the length of said region of abutment of the tongue rail (2) on the stock rail (1).

14. A switch according to claim 3, wherein a point with largest reinforcement of the tongue rail (2), or smallest width of the stock rail head, is located at a distance from the tip (3) of the tongue, which amounts to ⅕ to ⅓ of the length of said region of abutment of the tongue rail (2) on the stock rail (1).

15. A switch according to claim 2, wherein maximum head width reduction of the stock rail (1), or maximum reinforcement of the tongue rail (2), is 2 to 5 mm.

16. A switch according to claim 3, wherein maximum head width reduction of the stock rail (1), or maximum reinforcement of the tongue rail (2), is 2 to 5 mm.

17. A switch according to claim 2, wherein vertical height of the tongue rail (2) increases in the region of abutment on the stock rail (1) in the direction towards the end of abutment, departing from the tip (3) of the tongue.

18. A switch according to claim 3, wherein vertical height of the tongue rail (2) increases in the region of abutment on the stock rail (1) in the direction towards the end of abutment, departing from the tip (3) of the tongue.

19. A switch according to claim 2, wherein an inner flank of a flange of the carrying wheel, which encloses an angle of 50° to 70° with an axle of the carrying wheel, extends parallel with a tangent drawn at the tongue rail (2) and the stock rail (1), or contacts the rails along that tangent, at least in a region of largest reinforcement of the tongue rail (2).

20. A switch according to claim 2, wherein the switch is comprised of an inside curve switch, and a curve outer tongue rail is reinforced in cross section.

* * * * *